United States Patent [19]

Lawrence et al.

[11] 4,189,847

[45] Feb. 26, 1980

[54] PROCESS AND APPARATUS FOR REMOVAL OF AMMONIA IN A LIQUID AMMONIA FABRIC TREATING SYSTEM

[75] Inventors: Jackson Lawrence, West Sand Lake; Harry A. Webb, Menands, both of N.Y.

[73] Assignee: Cluett, Peabody & Co., Inc., New York, N.Y.

[21] Appl. No.: 860,921

[22] Filed: Dec. 15, 1977

[51] Int. Cl.[2] ..... F26B 7/00; F26B 3/00; F26B 21/14

[52] U.S. Cl. ..... 34/19; 34/32; 34/37; 34/75

[58] Field of Search ..... 34/36, 37, 19, 60, 32, 34/73, 75, 76, 72

[56] References Cited

U.S. PATENT DOCUMENTS

| | | | |
|---|---|---|---|
| 2,349,249 | 5/1944 | Desetti et al. | 34/60 X |
| 3,088,224 | 5/1963 | Cohn et al. | 34/37 X |
| 3,775,053 | 11/1973 | Wisdom | 34/32 X |
| 3,991,481 | 11/1976 | Coraor et al. | 34/73 X |

*Primary Examiner*—John J. Camby

[57] ABSTRACT

A process and apparatus are disclosed for removing ammonia from fabric which has been previously treated with liquid ammonia, by subjecting the fabric to a solution of water saturated with ammonia maintained at a temperature level high enough to vaporize ammonia in the fabric without requiring commercially uneconomical input of heat energy. Subsequent steps remove the remainder of the ammonia and water trapped in the fabric, the system providing essentially complete recovery of all ammonia at substantially reduced heat energy expenditure.

9 Claims, 1 Drawing Figure

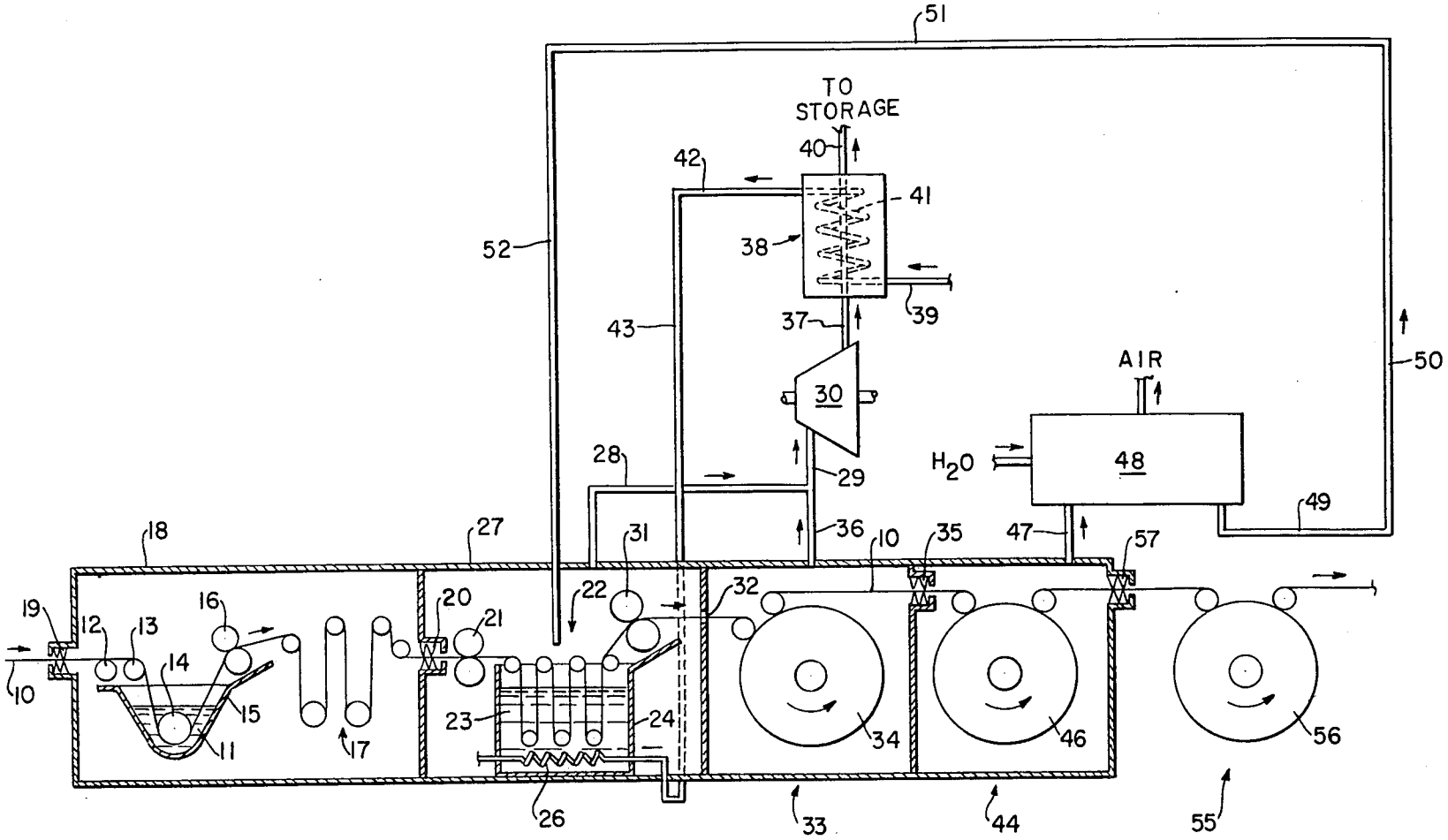
TO STORAGE
AIR
$H_2O$

PROCESS AND APPARATUS FOR REMOVAL OF AMMONIA IN A LIQUID AMMONIA FABRIC TREATING SYSTEM

BACKGROUND OF THE INVENTION

It is the objective of the present invention to achieve highly sufficient removal of ammonia from fabric by the use of water as a medium of heat exchange with a much lower temperature range than heretofore thought possible. The invention concerns a new and thermally unique technique for removing ammonia from fabric after treatment in a liquid ammonia bath. In accordance with previously known technology, after fabric is immersed in the liquid ammonia bath, it is squeezed free of excess ammonia by padder rolls which reduce the retained amount of ammonia to about 70% ammonia by weight of fabric. The remainder is then removed by passing the fabric through a palmer (dryer) to dry the fabric completely. The by-product of this drying step is aqueous ammonia for which a commercially feasible market must be found. Ammonia removed from the liquid ammonia treatment process due to its entrapment in the fabric and subsequent removal as described, must be replenished at more expense than can be recouped by the sale of the aqueous ammonia by product. The total energy cost for the removal of liquid ammonia in this conventional process has been calculated to be about 460 BTU's per pound of ammonia removed from fabric, where the fabric is a denim.

It has been proposed to remove ammonia from fabric subsequent to the liquid ammonia treatment by subjecting the fabric to a hot water bath only slightly below the boiling point of water, say at about 210° F. However, the thermal economics of treating fabric at such a temperature are not encouraging since it has been calculated that approximately 8500 BTU's must be expended in order to remove one pound of ammonia from fabric. Also, since the vapor pressure of water at this temperature is quite high, a great deal of water will accompany the ammonia being vaporized from the fabric, presenting a severe problem to recover the ammonia constituent, and requiring substantial amounts of energy to maintain the temperature of the bath (every pound of water vaporized at approximately 210° F. requires about 970 BTU's ).

SUMMARY OF THE INVENTION

The present invention is founded upon the basic discovery that water may be used as a medium of heat exchange for the removal of ammonia from fabric if the temperature of the water is not permitted to exceed say, 120° F., and if the temperature is preferably maintained at 60° F. to 65° F. Within the latter temperature range, the number of BTU's per pound of ammonia, leaving 30% moisture in the fabric, is very comparable to the number of BTU's needed to remove ammonia by the prior system described above. However, since the water temperature is quite low, vaporized ammonia escaping from a solution of water saturated with ammonia does not carry significant amounts of moisture with it, and consequently the vaporized ammonia is easily recoverable and converted into liquid ammonia again for recycling in the liquid ammonia treatment process. In accordance with a further inventive feature, when the recovered ammonia is compressed to the liquid state, it must be cooled and in the process gives up quantities of heat which can be used to maintain the temperature of the aqueous removal bath.

It should be pointed out that if the bath is maintained at a fairly low temperature (e.g. 60° F. to 65° F.), several advantageous effects result vis-a-vis compressing the recovered ammonia gas and the use of the heat of compression. In order to compress ammonia gas at a low temperature to its liquid state, about 100 pounds per square inch is required. If, however, the temperature of the bath is say 80° F., then 153 pounds per square inch would be required. Also, a great deal less horsepower is required to gas from atmospheric pressure to 100 pounds per square inch than would be required to compress gas to 150 pounds per square inch. Where the bath is maintained in the low temperature range of say, 60° F. to 65° F., the waste heat of compression produced by compressing the gas to its liquefication pressure at ambient temperature will be efficiently used to maintain the temperature of the bath. Where the bath is at a considerably higher temperature, it would not be possible to recover sufficient energy from the heat of compression to maintain the bath at an elevated temperature. Thus, a basic compatability exists where the bath temperature is at a low level which can be maintained efficiently by recovering the heat of compression of ammonia gas which is at the same low temperature of the bath.

When the heat compression is thus utilized, the number of BTU's needed to reduce the moisture in the fabric to 30% per pound of fabric is reduced to about 280, which is nearly 200 BTU's less than that required for the previous removal method (which required that the fabric be completely dried). The invention permits complete drying of fabric at a somewhat higher energy expenditure.

The present invention further provides primary, secondary and tertiary (the last being optional) drying stages for the removal of the aqueous solution from the fabric, the primary stage being sufficient to achieve a controlled fabric temperature of 180° F., the secondary stage being sufficient to achieve a controlled fabric temperature of 212° F., and the tertiary stage being used if the fabric is to be completely dried. Most ammonia from the aqueous solution in the fabric is driven off in the primary stage essentially without accompanying water vapor. This ammonia is recovered along with the ammonia vaporized by the aqueous ammonia bath. The secondary drying stage removes substantially the entire remainder of ammonia from the fabric and reduces the water content therein to 30% moisture level. The produce of the secondary stage is sent to a scrubber which delivers an aqueous solution for replenishment of the removal bath. The tertiary drying stage may be used optionally to completely remove the remaining water from the fabric, or to reduce the moisture content therein to some level intermediate 30% and fully dried. Thus, the system of the present invention totally recovers the ammonia remaining in the fabric, maintains the temperature of the removal bath by using the heat energy produced by compression, and the remaining small quantity of aqueous ammonia produced is returned to the removal bath.

BRIEF DESCRIPTION OF THE DRAWING

The single FIGURE discloses diagrammatically a system incorporating the principles of the present invention for removal of ammonia from fabric and recycling the products of said removal.

DESCRIPTION OF A PARTICULAR EMBODIMENT

Referring now to the drawing, fabric 10 is treated by immersion in a liquid ammonia bath 11 contained in a padder 15, by being passed about guide rolls 12 and 13 and thence about roll 14 within the pladder 15. The fabric is squeezed between padder rolls 16 and continues thereafter retaining about 80% ammonia by weight of fabric over a series of rolls 17 which guide and maintain tension on the fabric. The liquid ammonia bath is situated in a housing 18, the interior of which is maintained at a slight vacuum, end seals 19 and 20 preventing the entry of ambient air into the housing.

In accordance with the present invention, after leaving the liquid ammonia treatment housing 18, the fabric 10 passes between rolls 21 and thence over a series of vertically staggered rolls 22, the purpose of the latter being to guide and direct the fabric in a series of passes through a bath 23 which is water ($H_2O$) saturated with ammonia ($NH_3$). Bath 23 is contained within tank 24 and is maintained by heat exchange unit 26 at a predetermined temperature, preferably 60° F. to 65° F. Ammonia vapor will be driven off from the fabric as it passes through the tank 24, the vapor leaving the enclosure 27 through conduits 28, 29 to compressor 30, whose operation will be described subsequently.

Fabric 10, after leaving the tank 24, is squeezed between padder rolls 31 (which together with rolls 21 may be selectively controlled to maintain a predetermined amount of tension on the fabric 10 during the entire movement of the fabric through the treatment bath), thence through slot 32 into a primary dryer stage 33. The fabric passes around a dryer cylinder 34 (schematically only one has been shown), which is maintained at a fabric drying temperature of 180° F. At this temperature, primarily only the ammonia constituent of the aqueous ammonia solution will be driven from the fabric. Ammonia vapor leaves dryer stage 33 through conduit 36, and thence to compressor 30. Compressor 30 compresses ammonia vapor to ten atmospheres and the compressed ammonia passes through conduit 37 to a heat exchanger 38, which is cooled by incoming air brought through conduit 39. Having been cooled, the compressed ammonia gas becomes liquefied and passes from the heat exchanger 38 through conduit 40 to storage, where it may be used to replenish the bath 11. Cooling water entering heat exchanger 38 becomes heated in coils 41 passing from the heat exchanger through conduits 42, 43 through the removal bath 23 3, thereby maintaining the temperature of the bath. Suitable temperature controls will be used to direct the flow of incoming heated water for this purpose and to maintain the bath 23 at a predetermined temperature.

After leaving the primary dryer stage 33, fabric 10 next passes through seal 35 into a secondary dryer stage 44 where the fabric is directed around a dryer cylinder 46 (more than one may be required), maintained at a fabric temperature of 212° F. At such temperature, residual amounts of remaining ammonia and water are directed through conduit 47 into scrubber 48. The latter produces aqueous ammonia, which is recycled through conduits 49 through 52 to the aqueous ammonia removal bath 23. Substantially all ammonia is removed by the secondary dryer stage and the moisture (water) level in the fabric will be approximately 30%. The fabric 10 may be taken from the secondary dryer stage in this "wet" condition for subsequent treatment, i.e. wet finishing, dyeing, resin treating, compressive shrinking, etc. (although the latter may require partial drying to a moisture level of 15%. Such partial drying or complete drying, if desired, may be effected by passing the fabric 10 through seal 57 to the tertiary drying stage 55 wherein the fabric is directed around a dryer cylinder 56 (obviously more than one would be required). Therefrom the fabric will be taken to storage.

Naturally, the amount of energy required to completely dry the fabric will be greater than if the fabric is permitted to retain substantial moisture say, 30% by weight. The following table compares the expenditure of energy needed to remove ammonia from fabric utilizing an aqueous ammonia bath and to completely dry the fabric thereafter.

| Bath Temperature | BTU/lb. of Ammonia Removed |
|---|---|
| 210° F. | approximately 8500 |
| 176° F. | approximately 1450 |
| 158° F. | approximately 1150 |
| 116° F. | approximately 920 |
| 63° F. | approximately 800 |

When the fabric processed contains moisture ($H_20$), 30% by weight after ammonia removal, at a bath temperature of 63° F., the BTU expenditure per pound of ammonia recovered is 488 BTU's to deliver fabric "wet", i.e. having a 30% moisture content, which is quite comparable to the 460 BTU's required to deliver fabric dry of the prior system. When the heat of compression (of ammonia) is recovered to maintain the temperature of the bath at 63° F., the energy requirement drops to 283 BTU's to deliver fabric having 30% moisture per pound of ammonia recovered.

It will be understood that the above description has related to a particular embodiment or embodiments of the present invention and is therefore merely representative. In order to understand the scope of the invention, reference should be made to the appended claims.

We claim:

1. The method of recovering ammonia ($NH_3$) from a fabric web throughout which said ammonia is interspersed comprising the steps of (a) passing the web through an aqueous ammonia bath of water ($H_20$) saturated with ammonia ($NH_3$) maintained within temperature range of 60° F. to 120° F. to cause substantial vaporization removal of a major portion of said ammonia from said web;

(b) removing the aqueous ammonia solution from the web.

2. The method according to claim 1 wherein the aqueous ammonia solution is removed by subjecting the fabric to a sufficiently high fabric drying temperature.

3. The method according to claim 1 wherein the following steps are performed (c) squeezing excess aqueous ammonia from said webs;

(d) subjecting said web to dry heat at about 180° F. to remove essentially only residual ammonia from said web;

(e) subjecting said web to dry heat at about 212° F. to remove substantially the remainder of ammonia from said web and an amount of water from said web;

(f) compressing the vaporized ammonia steps (a) and (d) and cooling said compressed ammonia to a liquid to be used for further liquid ammonia treatment of the fabric web.

4. The method according to claim 3 wherein in step (e) the fabric is dried to about 30% moisture by weight.

5. The method according to claim 3 wherein following step (e) the fabric is essentially completely dried.

6. The method according to claim 3 wherein in step (c) excess aqueous ammonia is removed by squeeze rolls to have about 70% to 80% by weight of moisture.

7. The method according to claim 3 wherein the medium used to cool said ammonia in step (f) is used to maintain the temperature of the bath in step (a).

8. The method according to claim 7 in which the ammonia and water vapor as a product of step (e) is converted into aqueous ammonia and is used to replenish the bath of step (a).

9. The method according to claim 1 wherein the temperature range of the bath of water is preferably 60° F.–65° F.

* * * * *